US005947385A

United States Patent [19]

Lanerd et al.

[11] Patent Number: 5,947,385

[45] Date of Patent: Sep. 7, 1999

[54] VEHICLE TOWED APPARATUS FOR STRIPING OF ROADS

[75] Inventors: Lawrence L. Lanerd, Corcoran; James C. Schroeder, Ramsey; Bradley K. Voigt, Maple Lake, all of Minn.

[73] Assignee: Graco Inc., Minneapolis, Minn.

[21] Appl. No.: 08/838,248

[22] Filed: Apr. 17, 1997

Related U.S. Application Data

[60] Provisional application No. 60/015,637, Apr. 19, 1996.

[51] Int. Cl.[6] ..... A01G 25/09; B05B 1/20

[52] U.S. Cl. ..... 239/172; 239/146; 239/147; 239/155; 239/159; 239/164; 239/165

[58] Field of Search ..... 239/146, 147, 239/150, 155, 159, 164, 165, 172, 176

[56] References Cited

U.S. PATENT DOCUMENTS

| | | | |
|---|---|---|---|
| 2,057,655 | 10/1936 | Anthony et al. | 280/33.4 |
| 2,113,448 | 4/1938 | Hewitt | 280/33.4 |
| 2,179,586 | 11/1939 | Carpenter | 280/33.4 |
| 2,494,421 | 1/1950 | Wittke | 280/33.4 |
| 2,691,546 | 10/1954 | Torrance | 296/27 |
| 3,103,859 | 9/1963 | Dye | 239/150 X |
| 3,387,859 | 6/1968 | McClellan | 280/204 |
| 3,672,701 | 6/1972 | Blank | 280/414.5 |
| 4,041,002 | 8/1977 | Aboshi et al. | 260/30.6 R |
| 4,186,879 | 2/1980 | Kinder | 239/172 |
| 4,221,376 | 9/1980 | Handen et al. | 271/149 |
| 4,239,253 | 12/1980 | Golze | 280/460 |
| 4,310,997 | 1/1982 | Streicher | 56/149 |
| 4,410,194 | 10/1983 | Steilen | 280/86 |
| 4,442,975 | 4/1984 | Long et al. | 239/150 |
| 4,512,593 | 4/1985 | Ehrhardt | 280/460 |
| 4,624,602 | 11/1986 | Keiffer et al. | 239/172 X |
| 5,306,989 | 4/1994 | Feller, Jr. | 318/372 |
| 5,368,232 | 11/1994 | Schroeder | 239/150 X |
| 5,520,404 | 5/1996 | Schulte | 280/460.1 |

*Primary Examiner*—Andres Kashnikow
*Assistant Examiner*—Robin O. Evans
*Attorney, Agent, or Firm*—Douglas B. Farrow

[57] ABSTRACT

A line striper is attached to a vehicle with a two point hitch and has a swivelable rotatable wheel mounted thereunder to support the striper on the ground. A main beam is releasably clamped and may be slid from side to side depending on operator preference. The gun boom may then be located on the desired side. A delay feature on the control allows the operator to look ahead on a sighting camera and pick the point at which he or she desires striping to start (or stop or any other operation). The controller then compensates for the calibrated distance between the sight point and the spray gun and then starts and stops the gun at the appropriate time given road speed.

7 Claims, 7 Drawing Sheets

VEHICLE TOWED APPARATUS FOR STRIPING OF ROADS

This application claims benefit of provisional appln 60/015,637, filed Apr. 19, 1996.

BACKGROUND OF THE INVENTION

Apparatus for striping roads which does not require a dedicated vehicle is shown in U.S. Pat. No. 5,368,232, the contents of which are incorporated by reference. While such a device is quite effective, one drawback is that limited amounts of weight may be cantilevered off the rear end of a vehicle, particularly when the vehicle is smaller and/or has a relatively low load carrying capacity.

SUMMARY OF THE INVENTION

It is therefore an object of this invention to provide an apparatus which may be attached to most any vehicle and yet which may have a substantial amount of weight for the mechanism thereon.

It is further an object of this invention to provide a road striping apparatus which is easy to set up and operate by one person as compared to many of the prior art devices which require two operators.

It is further an object of this invention to provide a device in which a single paint applying boom may be easily and quickly switched from side to side and which may be easily placed in a transport position for transit between striping locations.

It is yet further an object of this invention to provide a device which is easy to set up and which provides a delay which encourages efficient one operator operation.

The device is intended to apply stripes to roadways to either match existing lines exactly or to apply new stripes per specification with one person operation. Such an operation is allowed by utilizing one person operation and providing a monitor delay system and easy to memorize finger touch controls. When the control system is powered up, all gun controls are switched to a guns off position and bead control is on; that is when any paint is turned on beads are applied to that paint. When powered off, all programmed skips, delays, and bead gun distances are retained in memory to be recalled if necessary.

The striping mechanism is designed for attachment to a towing vehicle by means of a two-point hitch and the rear of the striping mechanism is supported by a swivel mounted support wheel which in the preferred embodiment has a damping mechanism as well as spring mountings.

The support beam may be releasably clamped and moved from side to side so that the spray gun boom arm may be utilized on either side of the striping mechanism also by releasably clamping to the beam.

The bead tank is provided with a concave spherically shaped top having a central hole and a plug which is actually located in the tank and which may be pulled upwardly by means of a handle. Thus when the plug is pulled upwardly and the tank pressurized, the tank is sealed yet the tank may easily be filled by releasing pressure and popping the plug downwardly. The plug is retained from falling into the tank by means of a handle which is wider than the hole. During transport, the boom arm is swung upwardly and latched at the center of the mechanism. A gasoline engine powers a hydraulic power supply which in turn runs three hydraulic pumps for supplying of fluid at airless pressures to the three spray guns. The gasoline engine also powers a small air compressor which provides air pressure to the bead supply unit.

The control provides an auto cycle set up switch which allows the operator to stay in the vehicle and program the controller to place new lines over existing skip lines. When the auto cycle set up button is pressed, the skip set up screen appears on the LCD screen and the skip cycle will be flashing. The operator then simply pushes the mark button at the start and end of the cycle and the appropriate distance will appear on the LCD screen under the skip cycle. This can be accomplished at the same time the guns are painting by simply having the appropriate paint guns selected. For greater accuracy, the operator would want to stop on the first mark and then press mark then drive forward to the end of the cycle and stop again and press mark then back up and start painting. After the mark button has been pressed the second time, the auto cycle set up button turns off.

The cycle button can be changed any time thereafter by using up and down arrow keys. The paint line length is a manual input and can be changed at any time. The three guns may be independently switched on and off from one another and may either be switched into a solid striping regime or skip lines.

The delay button brings up the LCD screen for adjusting the feature monitor delay. The monitor delay is an important part of one man operation and eliminates the need for the operator to look back at the guns when starting, stopping and line changes. Simply make all line selections at the appropriate time when the cross hairs on the monitor reach these points. The delay distance is the number of feet from this point back to the paint guns. The microprocessor simply holds all keyboard commands for a set amount of traveled feet. The operator needs to watch the monitor for alignment purposes so it makes sense to run the paint controls from the same view screen.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

The following table shows the components:

| | | |
|---|---|---|
| A | Viscount I Hydraulic Motor | Operates the displacement pump |
| B | Boom Arm Hitch Pin | Secures spray gun boom arm when the Striper is in transport |
| C | Displacement Pump | Provides fluid to be sprayed through spray gun |
| D | Fluid Filter | Filters fluid between source and spray gun |
| E | Breather Cap | Provides a means for hydraulic reservoir ventilation, oil check and fill |
| F | Pressure Drain Valve | Relieves fluid pressure when open |
| G | Fluid Outlet Tube | Hose carries fluid from displacement pump to spray gun |
| H | Hydraulic Reservoir | Holds 12 gallons of hydraulic oil for hydraulic pump |
| I | Hydraulic Select/Bypass Valve | Selects displacement pumps for guns 1 & 2, or 3; or bypasses all guns |
| J | Hub | Allows trailer wheel to swivel |
| K | Hydraulic Pump | Creates hydraulic pressure for the hydraulic power supply system |
| L | Main Beam | Supports spray gun boom arm |
| M | Bead Tank | Holds up to 300 lb. of glass beads for continuous spraying |
| N | Air Regulator | Allows regulation of bead tank air pressure |
| O | Compressor | Provides pneumatic supply to switch paint spray gun and bead spray guns on and off as directed by the programmable skipline control |
| P | Engine | 18.0 HP gasoline engine |
| R | Tail Light | Standard tail light that includes brake and directional lights |
| S | Hydraulic Pressure Knob | Provides adjustment of hydraulic pressure. Clock wise rotation increases pressure. Pressure setting is locked with inner lock knob. |
| T | Dolly | Used to roll Striper into place for connection to tow vehicle and hold Striper upright when disconnected from tow vehicle and stored |
| U | Spray Gun Boom Arm | Allows striping on either side of the tow vehicle at adjustable distances |
| V | Bead Spray Gun | Sprays beads when commanded by the programmable skipline control |
| W | Paint Spray Gun | Sprays fluid when commanded by the programmable skipline control |
| X | Fuel Tank | Holds gasoline |

Figure 8:
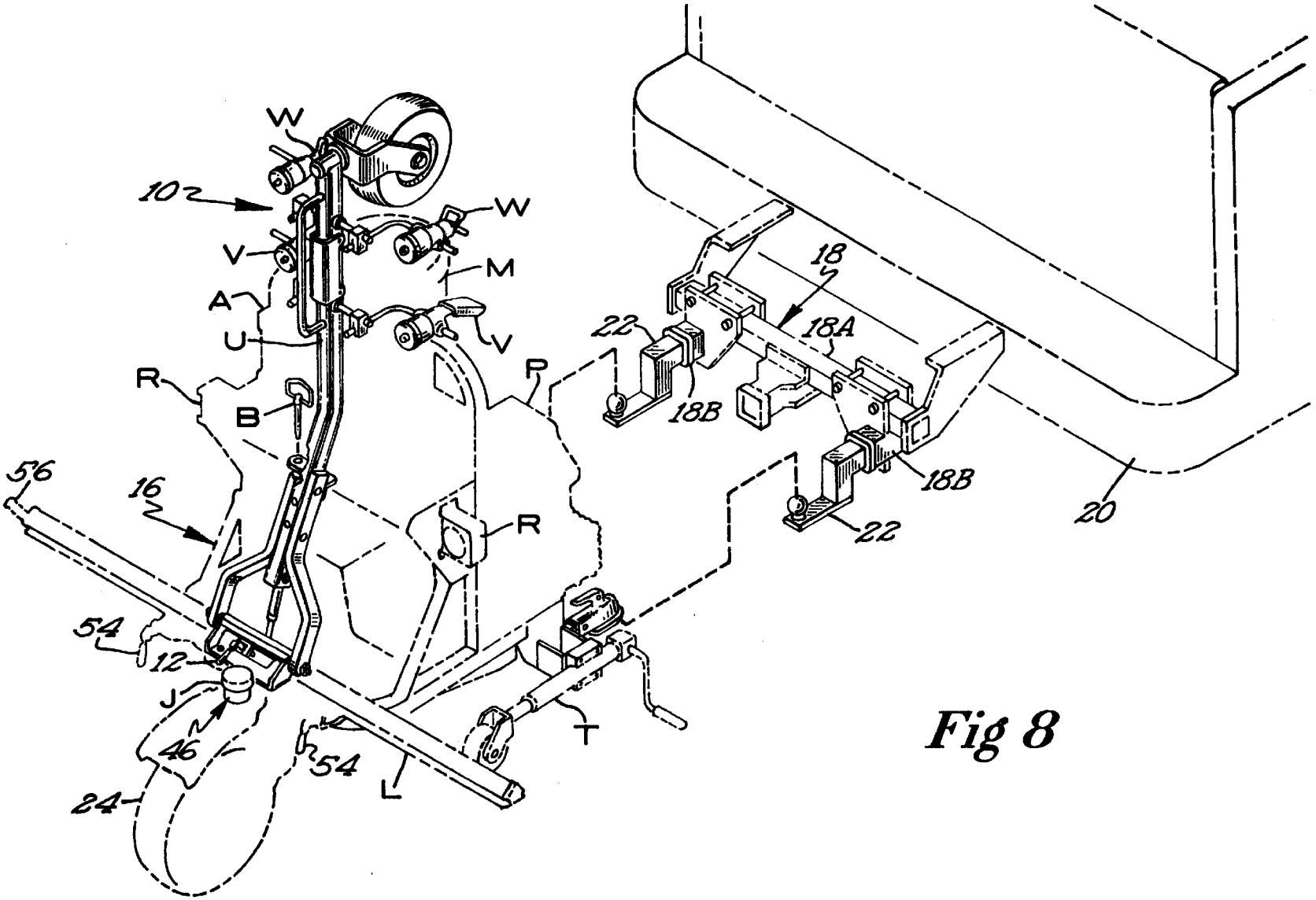
FIG. 8 is an perspective view of the instant invention in transport position.

FIG. 8 shows gun carriage 10 in its transport position when it is swung up and locked. The paint pumps C in the preferred embodiment are a hydraulically (A) operated pump C of the Viscount line also manufactured by Graco Inc. When it is desired to paint, the boom arm U is unlatched and slid to one end where it is locked using the latches 12, wherein it may then pivot and is supported by the road wheel 14.

The framework 16 of the striping mechanism 10 itself attaches to the vehicle by means of two receivers 22 holding trailer hitch balls of conventional design. Thus the two-point hitch 18 (one side is shown with an identical hitch on the other side) allows the striping mechanism 10 to maintain absolute linearity with the vehicle 20 itself and does not suffer from articulation problems present in typical trailers. A pivotable wheel 24 is located on the rear end of the striping frame to provide support and a damping mechanism 46 is utilized in hub J in order to prevent the swivel wheel 24 from becoming unstable at speed.

Figure 10:
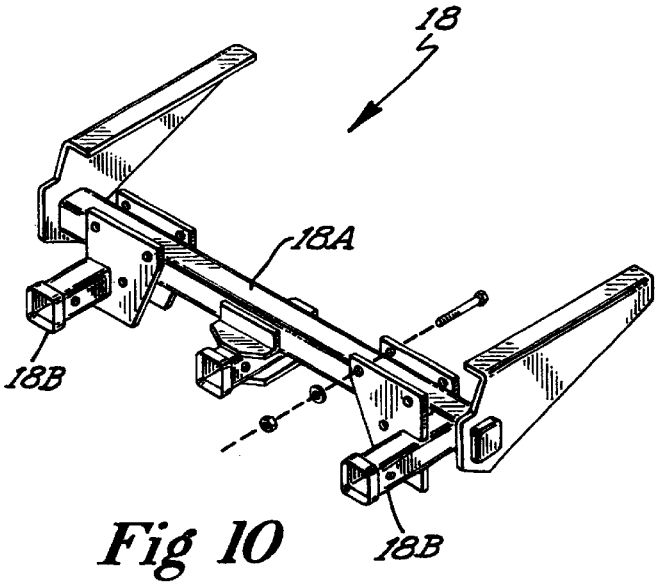
FIG. 10 is a perspective view of the two point hitch.

FIG. 10 shows the two point hitch 18 having a hitch frame 18A which is part of a normal frame mounted hitch such as manufactured by DRAW-TITE. Two hitch receivers 18B are clamped to frame rail 18A as shown allowing use of standard hitches for the two point hitch 18.

As can be seen on the frame 16, the three pumps C which each are designed to pump two different colors (typically one being white and the other being yellow) are driven off a common gasoline engine P and hydraulic power supply K.

A bead container M is utilized along with a small compressor O driven off the same gasoline engine P and the bead container M is pressurized in order to supply beads to the bead gun V. The bead container M is provided with a knockout plug 60 of the type commonly used in sandblasting equipment and a depressed upper surface 58 which allows easy loading of beads and quick locking and sealing of the container M.

Figures 6, 7:
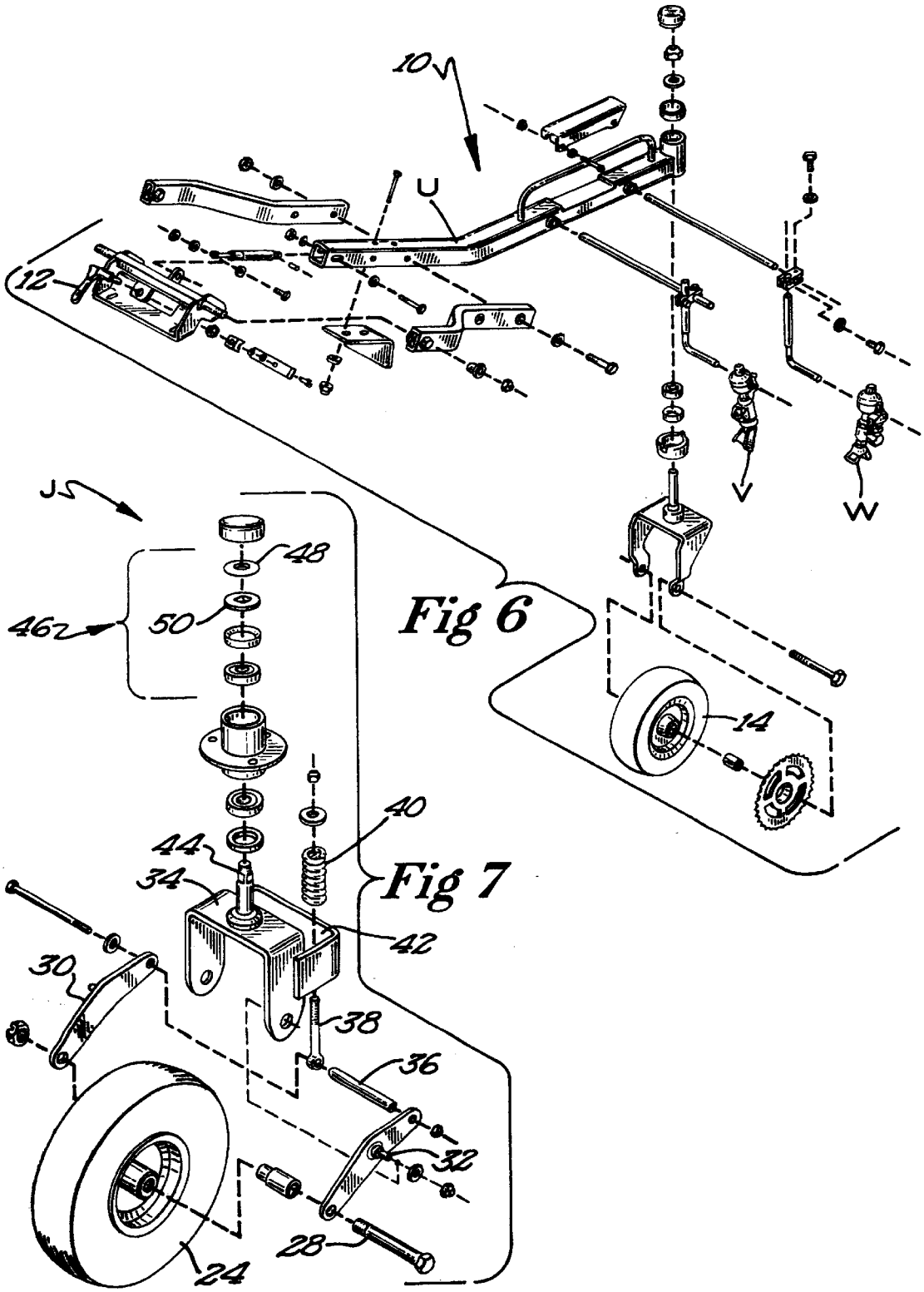
FIG. 6 is an exploded view of the boom of the instant invention.
FIG. 7 is an exploded view of the caster wheel of the instant invention.

As can be seen particularly in FIG. 7, wheel 24 rides on axle 28 and pivot member 30 which pivots about pivot point 32 on swivel fork 34. A spring pivot (36) mounts a pair of rod ends (38) which extend through springs 40, into mounting plate 42. Thus, rod ends (38) are always under tension and serve to compress springs 40, and under suspensions, loads will compress even more.

Swivel axle 44 extends upwardly from swivel 34 through damping mechanism 46 in Hub J. One or more belleville washers (48) serve to preload a damping surface member (50) which may be manufactured from an acetal homopolymer (100AF); which is impregnated with Teflon or a similar material.

As can be seen in the figures, the carriage rod/main beam L may be unlocked and moved to either side of the vehicle and thence the boom arm moved to the outside of the carriage rod L so that the stripe may be positioned as desired. When it is desired to detach the striping mechanism from the vehicle, two supports T are cranked down by hand which lift the two hitch mechanisms 18 off the balls and allow the whole mechanism to be wheeled away from the vehicle.

Frame 16 has a channel 52 thereon, with a pair of clamps (54) of the over-center type serve to clamp and retain main beam L in the channel 52. Main beam L is desirably manufactured from a piece of square tubing with a piece of plate welded to one corner thereof, with clamps 54 gripping the steel plate. Bolts (56) may be inserted on either end to limit the travel of main beam L. Upon reaching the job site, the operator may merely unlatch transport pin B and unclamp clamps 12 and 54. The operator can then extend main beam L to the side on which it is desired a stripe and spray gun boom arm (U) moved outwardly to the striping position and clamp 12 locked again with boom U lowered so that road wheel 14 contacts the ground. The spray guns (W), may then be positioned as desired along with bead guns (V).

Figure 9:
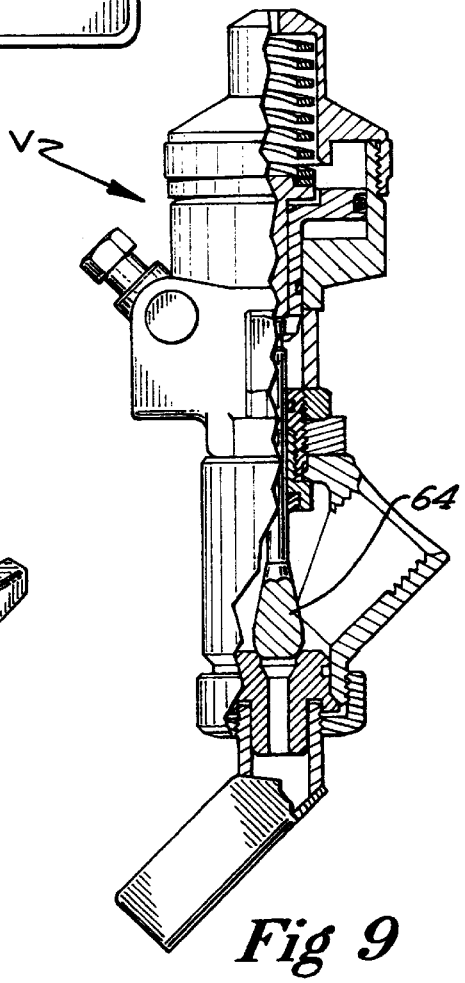
FIG. 9 is an exploded view of the bead gun.
Figure 3:
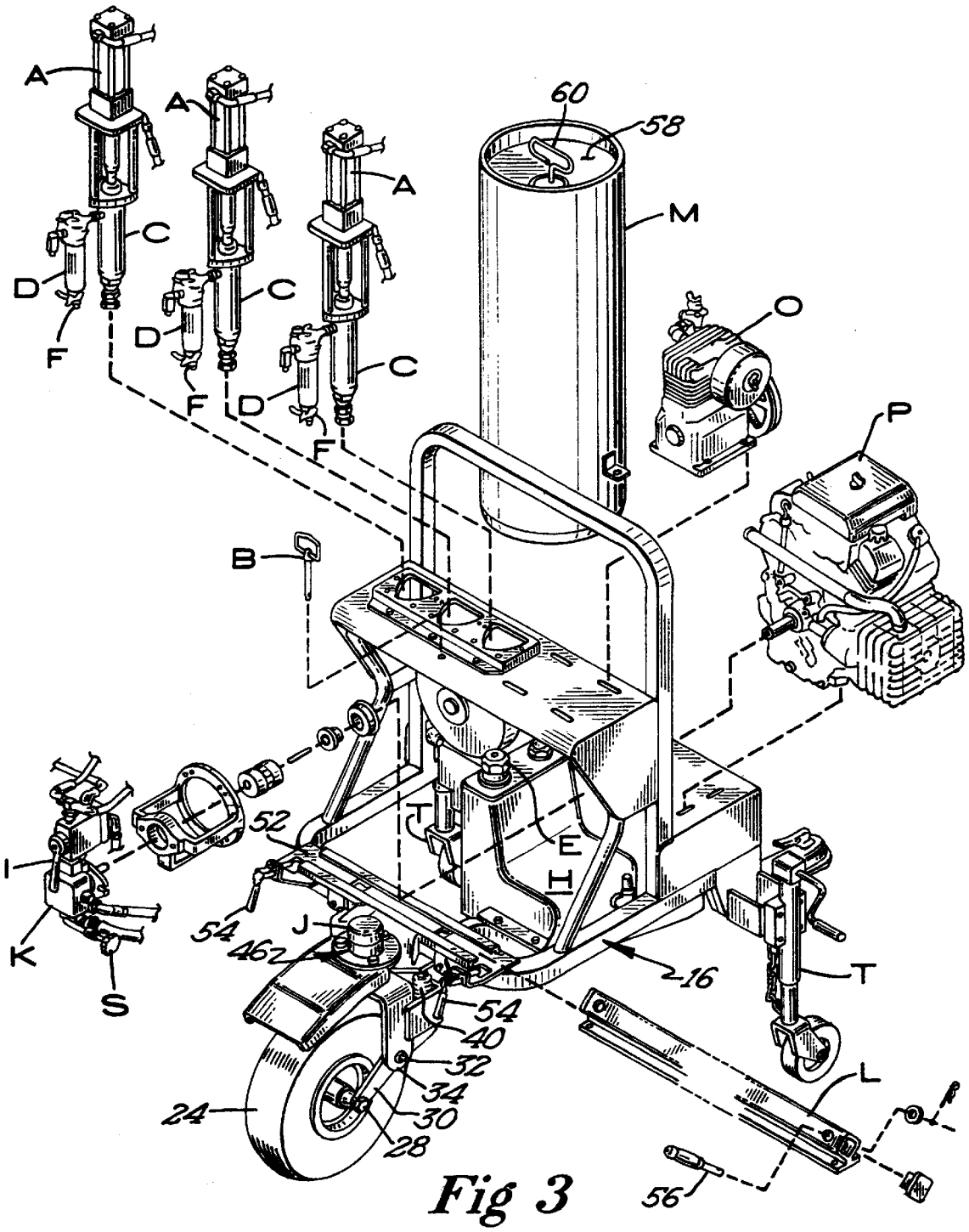
FIG. 3 is a partially exploded view of the instant invention.
Figure 4:
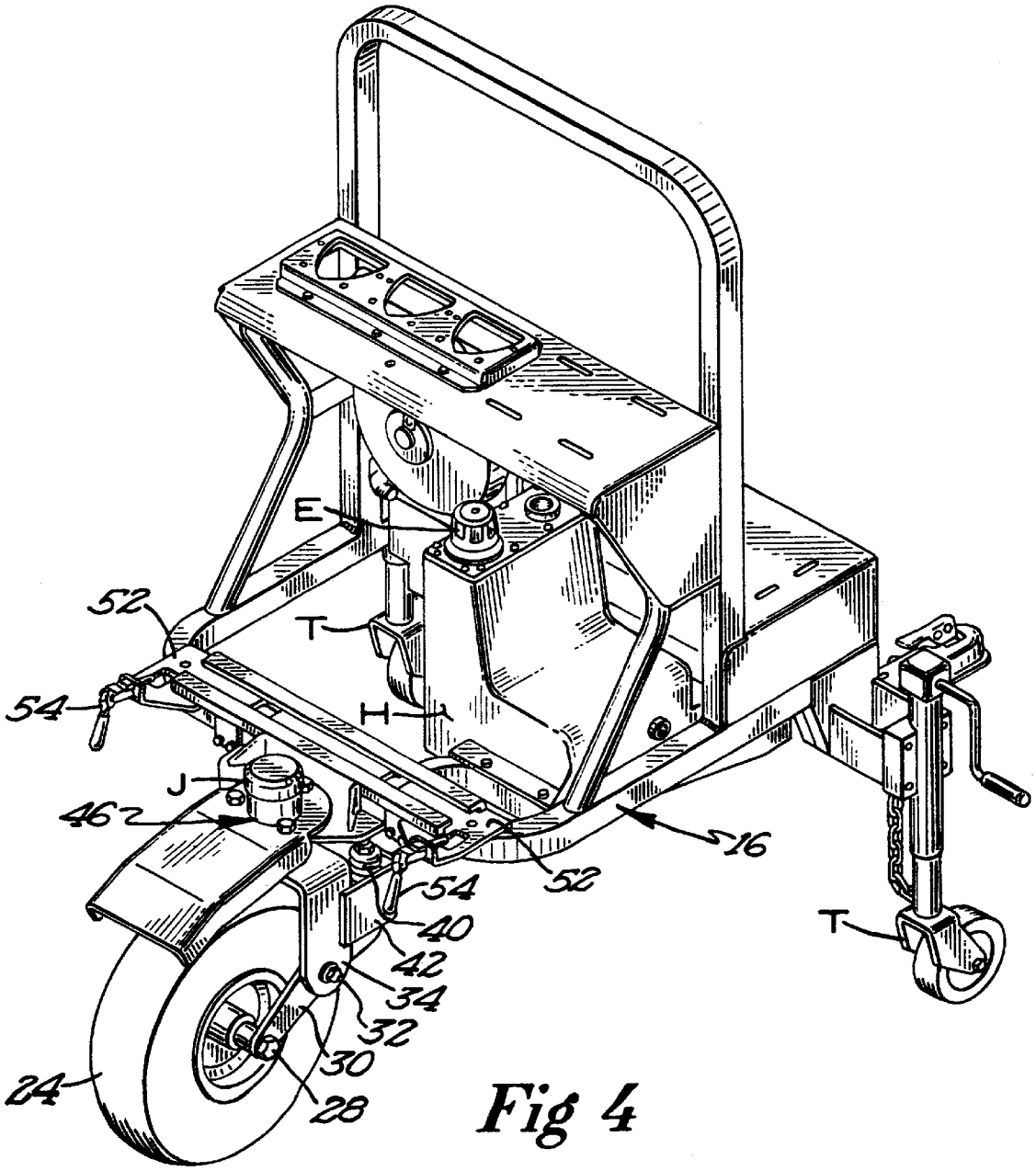
FIG. 4 is a view of the frame of the instant invention.
Figure 5:
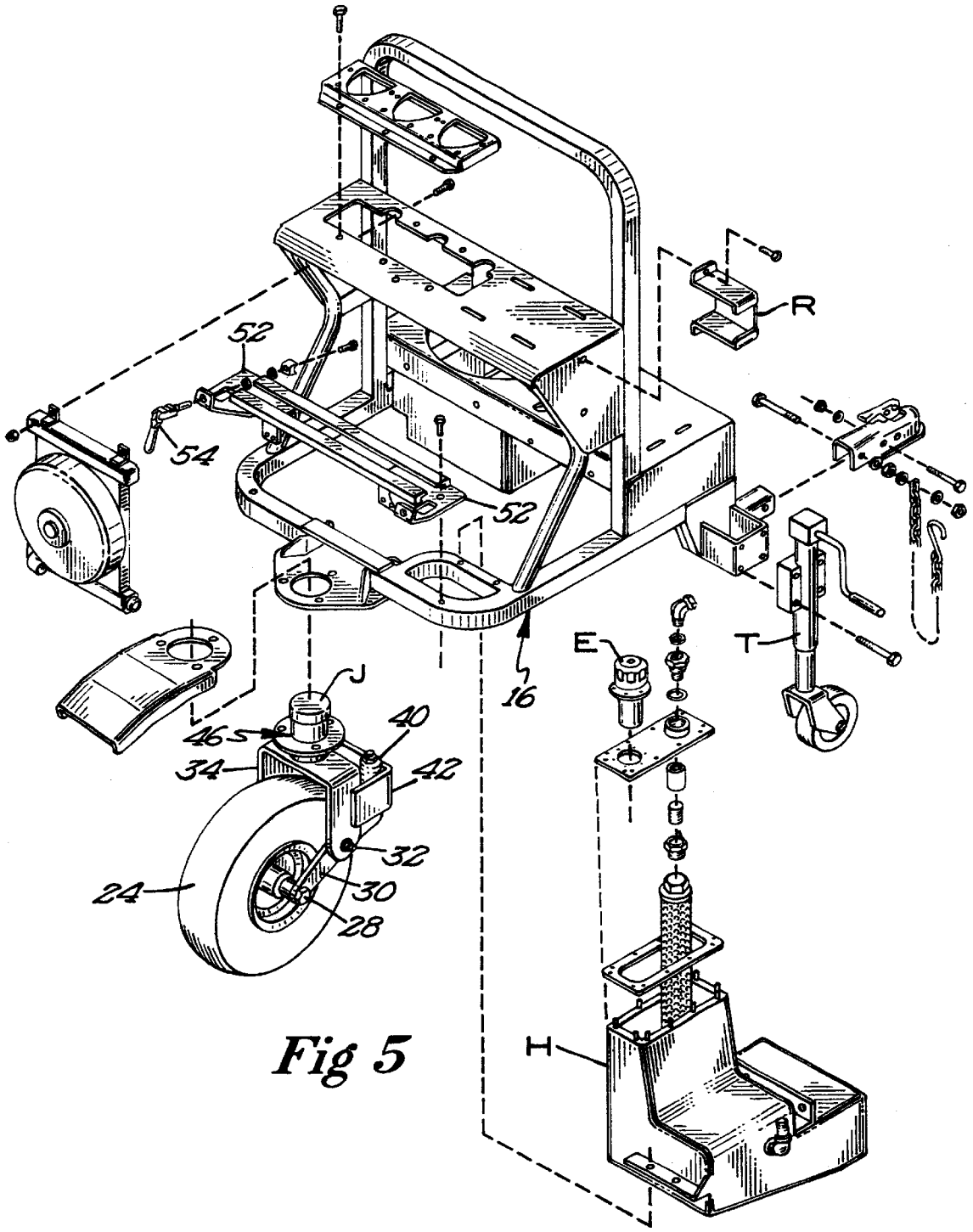
FIG. 5 is an exploded view of the frame of the instant invention.

Bead guns V are shown in more detail in FIG. 9 and have a teardrop shaped needle 64 which reduces chattering by encouraging laminar flow therethrough.

Figure 1:
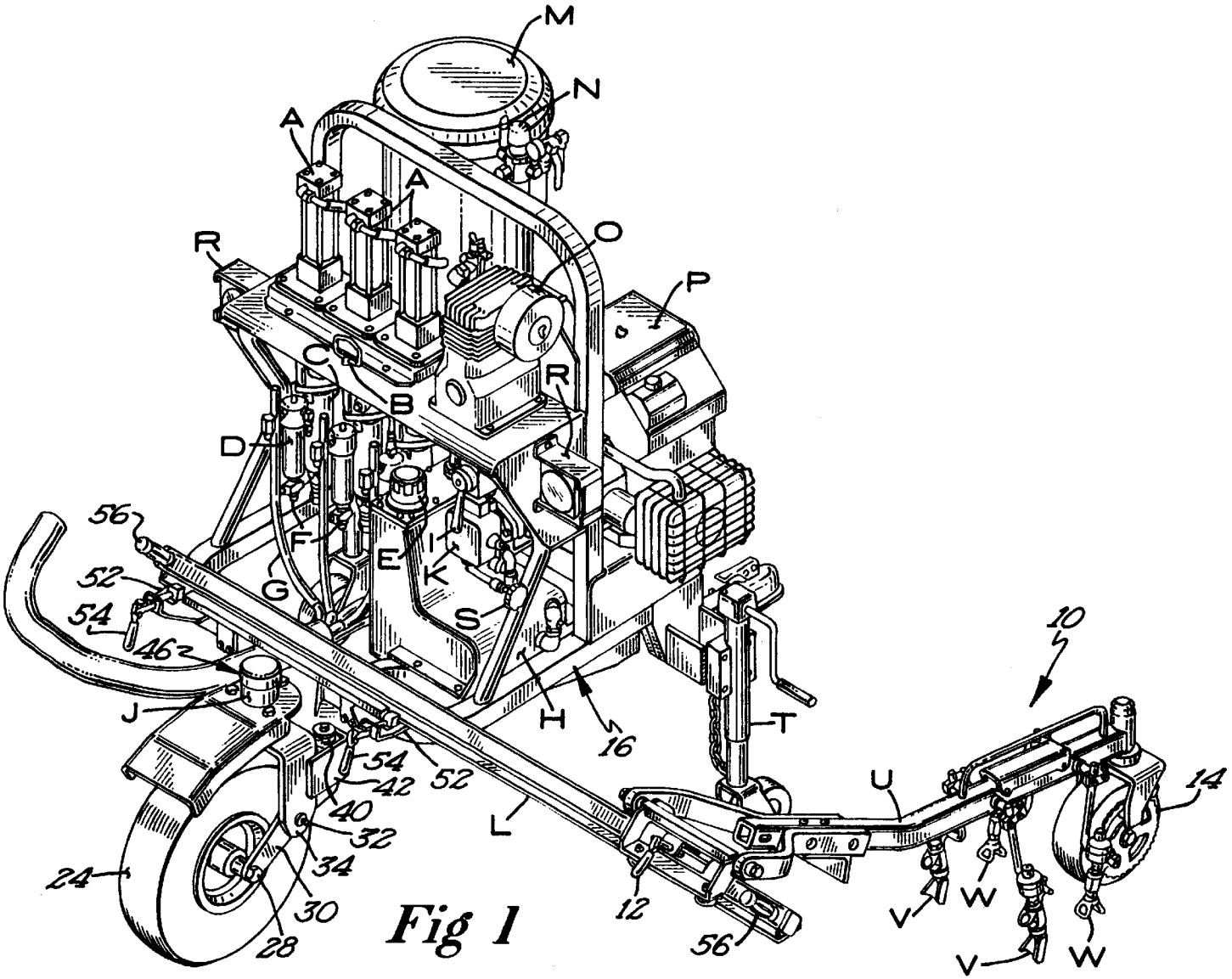
FIG. 1 is a perspective view of the instant invention.
Figure 2:
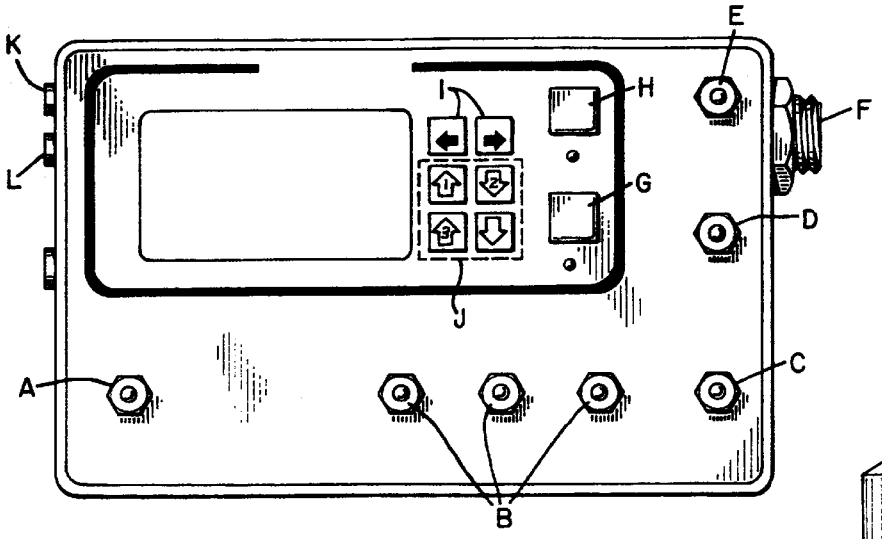
FIG. 2 is a frontal view of the control panel of the instant invention.

The attached operation instructions show the menu flow chart for the controller and help explain set up and operation. The following table expands on the controls shown in FIG. 2:

| | switch/Indicator | Explanation |
|---|---|---|
| A | POWER ON/OFF switch | ON enables battery DC power to the Control and to the engine. OFF removes power from the Control and the engine. Engine can not be started when this switch is in the OFF position. |
| B | Paint gun switches 1, 2 and 3 | Enables/disables paint gun 1, 2 and 3. |

-continued

| | switch/Indicator | Explanation |
|---|---|---|
| | | Up - dashed line.<br>Center - off.<br>Down - continuous line. |
| C | RESET/HOLD switch | HOLD disables paint guns 1,2 and 3 and resets the internal cycle counter. |
| D | ADV/RET switch | Used in conjunction with the arrow switches to adjust the paint line position to match a previously painted line. ADV allows the dash line to be moved forward. RET allows the dash line to be moved closer. |
| E | BEADS ON/BEADS TEST | Enables/disables bead gun<br>BEADS ON (up) - beads start to flow when paint guns start to paint.<br>Center - off.<br>BEADS TEST (down) - continuous bead flow. |
| F | I/O cable port | The I/O cable connects here and at the RL. Also brings in 12 Vdc from the RL<br>in the paint and cycle length menu. |
| H | SYSTEM DELAY ON/OFF | OFF (unlit) - the paint guns and RESET/HOLD respond immediately.<br>ON (lit) - the paint gun switches 1, 2 and 3; and RESET/HOLD switch are delayed by the preset system delay distance. |
| I | MENU arrow switches | Used to switch between menus, adjusting values and resetting values. |
| J | Arrow switches 1, 2, 3 and blank | Used in conjunction with the ADV/RET switch to adjust the paint line position to match a previously painted line. When the ADV/RET switch is in the ADV position, pressing the arrow switch moves the dash line forward, incrementally. When the ADV/RET switch is in the RET position, pressing the arrow switch moves the dash line closer. |
| K | Remote mph display plug-in | Provides mph output to REMOTE MPH DISPLAY |
| L | Remote control switch plug-in | Provides two remote functions for the paint gun switches 1, 2 and 3:<br>1. Skip line - acts as a cycle reset when tapped and a cycle hold when held down. Has no effect on solid line painting.<br>2. Solid line - turns paint guns on when hald down and off when released. |

It is contemplated that various changes and modifications may be made to the line striper without departing from the spirit and scope of the invention as defined by the following claims.

What is claimed is:

1. A mechanism for line striping and designed to be attached to a vehicle, said mechanism comprising:

a frame;

means for attaching said frame to said vehicle at least two points allowing said frame to move only vertically;

a ground-engaging wheel mounted to said frame, said wheel being mounted so as to be capable of swiveling about a generally vertical axis relative to said frame and to rotate about a generally horizontal axis, said ground-engaging wheel being capable of rollably supporting said mechanism during striping operations and being the sole point of contact; and means for applying a stripe attached to said frame.

2. The line striping mechanism of claim 1 further comprising means for damping said swiveling.

3. The line striping mechanism of claim 2 wherein said damping means comprises a preloaded impregnated acetal homopolymer friction surface.

4. The line striping mechanism of claim 1 wherein said attaching means comprises:

a vehicle frame hitch having a frame rail; and first and second hitch receivers clamped to said frame rail.

5. A mechanism for line striping and designed to be attached to a vehicle having a direction of travel, said mechanism comprising:

a frame having first and second sides;

means for attaching said frame to said vehicle;

a main beam releasably attached to said frame perpendicular to said direction of travel and extendible to either of said sides without removal from said frame;

a pivoting boom arm slideably and releasably clamped to said main beam and being slideable to either of said sides without removal from said frame; and means for applying a stripe attached to said frame.

6. The line striping mechanism of claim 4 further comprising means for locking said boom arm in an elevated position during transport.

7. A mechanism for line striping and designed to be attached to a vehicle having a direction of travel, said mechanism comprising:

means for striping;

means for the operator of said vehicle to sight a desired point along a line to be striped ahead of said vehicle;

means for measuring and storing the delay distance between said striping means and said desired point;

means controlling said striping means so as to utilize said delay distance to initiate a striping action with said striping means at said desired point.

* * * * *